United States Patent [19]

Templeton

[11] 4,448,101

[45] May 15, 1984

[54] SHEAR CUTTER

[75] Inventor: John G. Templeton, Grand Rapids, Mich.

[73] Assignee: Bulman Products, Inc., Grand Rapids, Mich.

[21] Appl. No.: 312,393

[22] Filed: Oct. 19, 1981

Related U.S. Application Data

[63] Continuation-in-part of Ser. No. 126,960, Mar. 3, 1980, abandoned.

[51] Int. Cl.[3] ..... B26D 1/04; B26D 1/14

[52] U.S. Cl. ..... 83/374; 83/478; 83/489; 83/508; 83/583

[58] Field of Search ..... 83/374, 485, 489, 508, 83/542, 583, 614, 649, DIG. 1, 397–398; 30/292

[56] References Cited

U.S. PATENT DOCUMENTS

| | | | |
|---|---|---|---|
| 992,755 | 5/1911 | Crocker | 30/292 |
| 1,434,475 | 11/1922 | Austin | 83/485 |
| 1,609,093 | 11/1926 | Miller | 83/614 |
| 1,735,520 | 11/1929 | Williams | 83/508 |
| 1,774,225 | 8/1930 | Bredin | 83/485 |
| 2,503,353 | 4/1950 | Pugh | 83/485 |
| 3,447,409 | 6/1969 | Lewis | 83/583 |
| 3,799,022 | 3/1974 | Nagel et al. | 83/583 |
| 3,858,475 | 1/1975 | Thater | 83/583 |

*Primary Examiner*—E. R. Kazenske
*Assistant Examiner*—Hien H. Phan
*Attorney, Agent, or Firm*—Price, Heneveld, Huizenga & Cooper

[57] ABSTRACT

A cutter for sheet materials, packing or cushioning materials, and the like, comprises an elongate, hollow cutter bar or housing having a spring blade pivotally mounted therein, with the upper edge of the blade positioned in a longitudinal slot in the bar. A circular knife is slidably carried on the bar, and includes a cutting edge which engages the blade to shear the sheet therebetween as the circular knife is moved along the bar. The blade is normally biased into a safety position, wherein the upper edge of the blade is retracted into the bar slot. Engagement between the circular knife and the blade automatically shifts the adjacent portion of the blade into a cutting position with the knife, wherein the upper edge of the blade is extended from the retracted, storage position to a cutting position, flush with the upper surface of the cutter bar to cleanly and evenly shear the material between the blade and the knife.

20 Claims, 13 Drawing Figures

SHEAR CUTTER

CROSS REFERENCE TO RELATED APPLICATIONS

The present invention is a continuation-in-part of my co-pending parent application Ser. No. 126,960, filed Mar. 3, 1980, entitled SHEET CUTTER, now abandoned which is hereby incorporated by reference.

BACKGROUND OF THE INVENTION

The present invention relates to cutters, and in particular, to cutters for sheet material, packing or cushioning material, and the like. Since some safety hazards are inherently associated with the operation of cutting machines, it is desirable to provide a cutter which is as safe as possible during normal operating conditions.

It is also desired that the sheet cutter be capable of making clean, even, straight cuts across the entire width of the material. Some cutting devices tend to push the sheet to one side as the blade shears through the same, thereby causing an uneven or nonlinear cut. If the shearing angle of the cutting blades is not properly matched with the position of the sheet, the blades will rip the sheet instead of cutting it, thereby creating a ragged, uneven edge.

It is further desirable to provide a cutter which is extremely durable, and capable of cutting relatively thick packaging or cushioning material, such as urethane and polyethylene foam, bubble cushioning products, poly films, kraft paper backed cushioning products, and other cellulosic cushioning products.

SUMMARY OF THE INVENTION

The present invention is a material cutter, comprising a cutter bar or housing having a hollow interior with a longitudinal slot through one face thereof. A blade is mounted in the interior of the bar for angular displacement or movement therein, and includes an upper edge disposed adjacent the slot. A movable knife is slidably mounted on the cutter for translation along the slot, and includes a cutting edge abuttingly engaging the upper edge of the blade for shearing material therebetween as the knife is moved along the bar. Means are provided for rotating or shifting the blade, preferably pivotally, between an extended, cutting position, wherein the upper edge of the blade is disposed substantially flush with the outer surface of the slotted bar face for cutting the material, and a retracted, safety position, wherein the upper edge of the blade is disposed below the outer surface of the slotted bar face for storage.

The spring blade may be semi-flexible, with a resilient strip attached thereto to normally pivot the blade into the retracted safety position. The knife is preferably circular and slidably mounted along the bar, such that engagement between the circular knife and the blade automatically pivots or shifts the blade into the extended cutting position. Only that portion of the spring blade which is adjacent the cutting area is in the cutting position, and the remainder of the blade is retracted and stored.

In one embodiment of the present invention, the upper edge of the spring blade is sharpened to an acute angle for cutting paper, and other relatively thin sheet materials.

In another embodiment of the present invention, the upper edge of the spring is dull (i.e., blunt, not sharp) for cutting relatively thick materials, such as plastic foam, bubble cushioning, and the like.

The principal objects of the present invention are: to provide a safe, durable cutter for materials, having a retractable blade which extends to the lower surface of the material during a cutting position to achieve a clean, even cut, and shifts into a retracted position for storage; to provide a cutter having a device for holding the material down on either side of the knife for shearing along a straight line; to provide a cutter having a circular knife which automatically shafts progressive portions of the blade from the retracted position into the cutting position; to provide a cutter having a semi-flexible spring blade which bends around the knife, such that only that portion of the blade adjacent the area being cut is in the extended, cutting position, and the remainder of the blade automatically remains in the retracted, storage position; and to provide a cutter which is economical to manufacture, efficient in use, capable of a long operating life, and particularly well adapted for the proposed use.

These and other features, advantages and objects of the present invention will be further understood and appreciated by those skilled in the art by reference to the following written specification, claims and appended drawings.

DETAILED DESCRIPTION OF THE PREFERRED EMBODIMENTS

Figure 1:
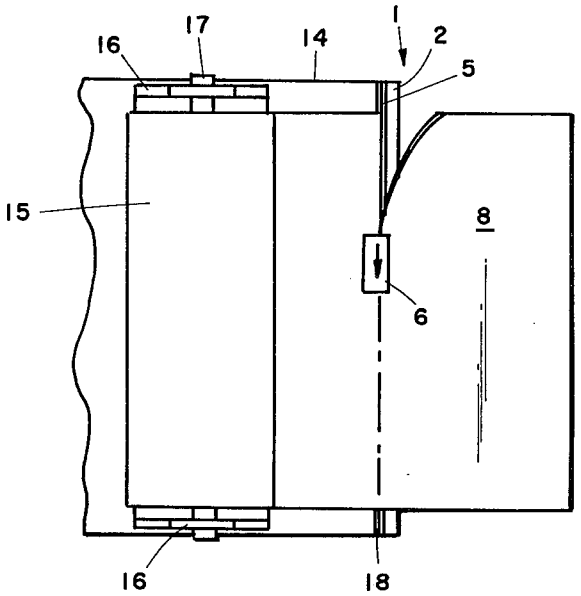
FIG. 1 is a schematic top plan view of a cutter embodying the present invention, shown attached to a cutting table.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary.

Figure 2:
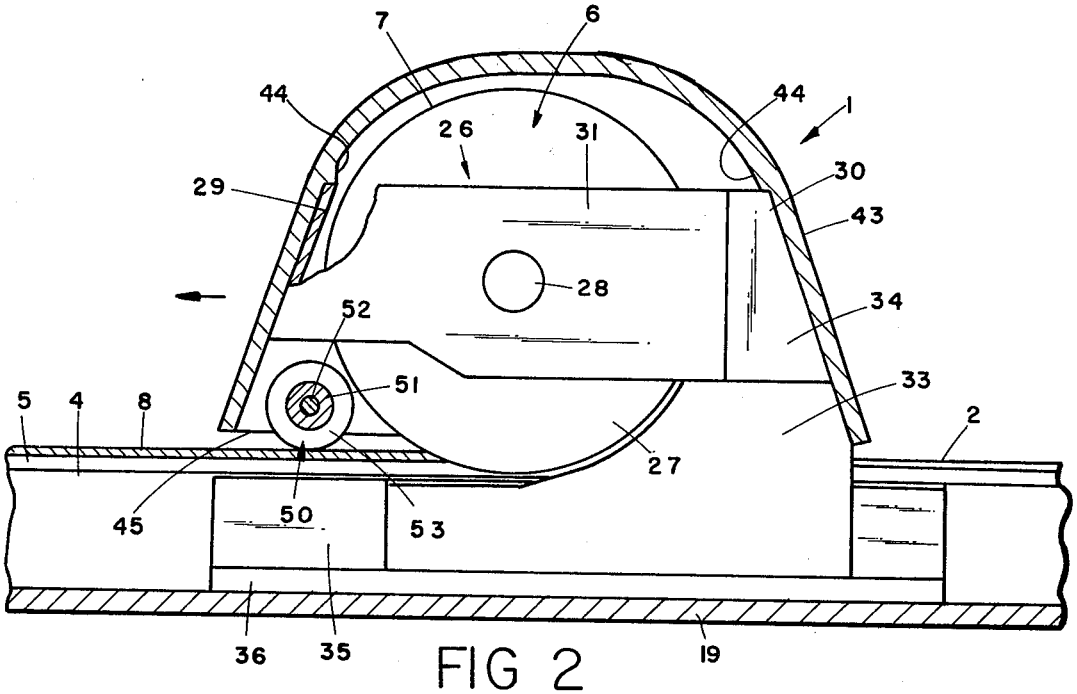
FIG. 2 is an enlarged fragmentary vertical cross-sectional view of the cutter, taken from the side thereof.

The reference numeral 1 (FIGS. 2 and 3) generally designates a cutter embodying the present invention, comprising a hollow cutter bar or housing 2 having a spring blade 3 pivotally positioned therein, with the upper edge 4 of the blade located in a longitudinal slot 5 in the bar 2. A circular knife assembly 6 is slidably associated with cutter bar 2, and includes a cutting edge 7 which engages blade edge 4 to shear material 8 therebetween as circular knife assembly 6 is moved along cutter bar 2. A biasing means, such as resilient strip 9, is attached to blade 3 and normally pivots the same to a storage position (FIG. 8), wherein blade edge 4 is retracted into bar slot 5. Engagement between circular knife 6 and blade 3 automatically pivots or shifts blade 3 into a cutting position (FIG. 7), wherein the blade is extended into slot 5 to abut and shear the material.

As best illustrated in FIG. 1, cutter 1 is particularly adapted to be mounted on a cutting table 14, having a roll of material 15, such as paper, synthetic film, cloth, foam packing, bubble cushioning, or the like, rotatably mounted between a pair of supports 16 on an axle 17. The cutter 1 is attached to table 14, such that cutter bar 2 extends laterally across the entire width of the material 8, with the uppermost surface of the bar either above or substantially flush with the top of the table. When very thick panels of material are being cut, roll 15 can be removed, so that the panels can be fed directly over the top of cutting table 14. A hold-down guide 18 is preferably mounted on table 14 just upstream of cutter 1 to control material tension and eliminate backup when cutting packing and cushioning materials. It is to be understood that the above-described cutting table is merely one example of how the present cutter 1 may be mounted, and is not to be interpreted as limiting.

The alternate terms "sheet" and "web" are intended to encompass these various materials regardless of length and/or width thereof.

Figure 7:
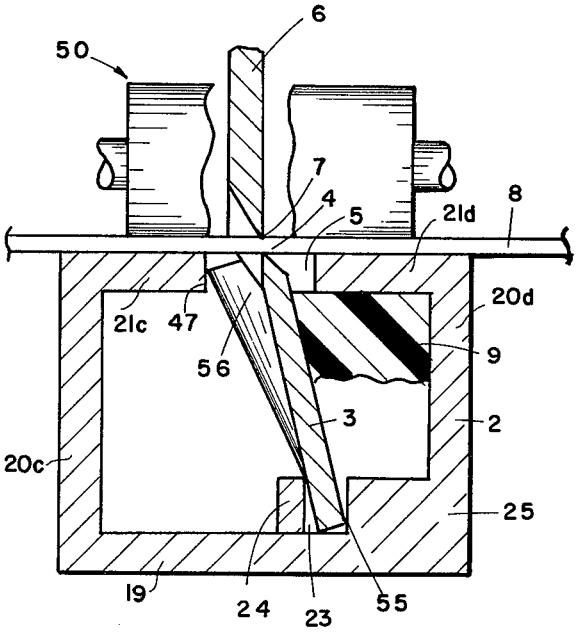
FIG. 7 is an enlarged fragmentary vertical cross-sectional view of the cutter, with the nearest portion of the blade shown in an extended, cutting position.
Figure 8:
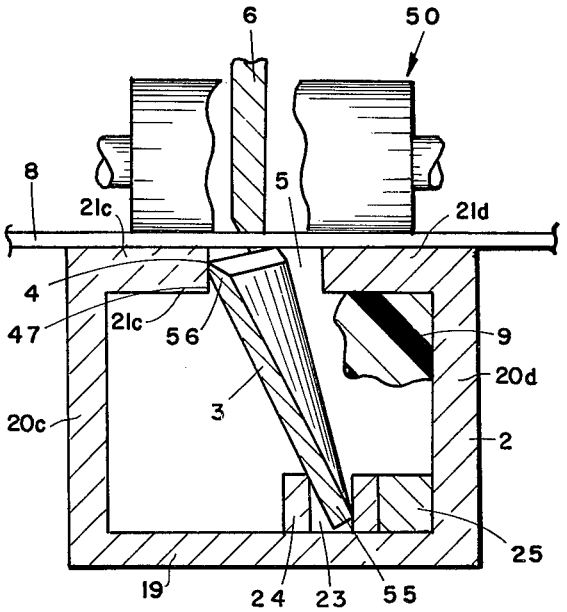
FIG. 8 is an enlarged fragmentary vertical cross-sectional view of the cutter, with the nearest portion of the blade shown in a retracted, safety position.
Figure 3:
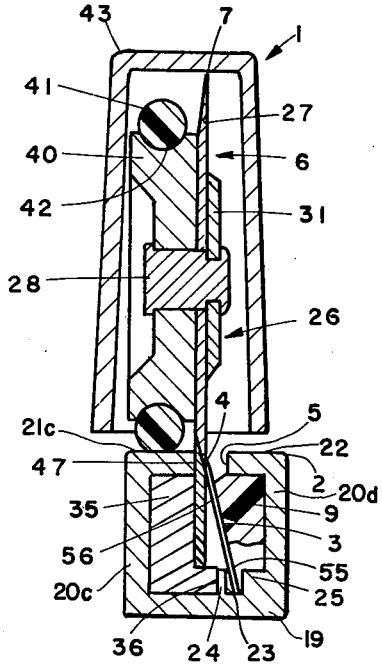
FIG. 3 is an enlarged vertical cross-sectional view of the cutter, taken from the end thereof.
Figure 4:
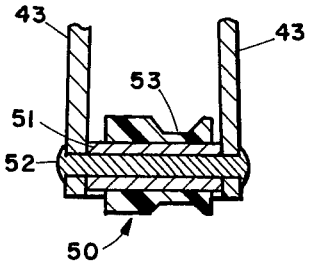
FIG. 4 is a fragmentary horizontal cross-sectional view of a hold-down roller portion of the cutter.
Figure 9:
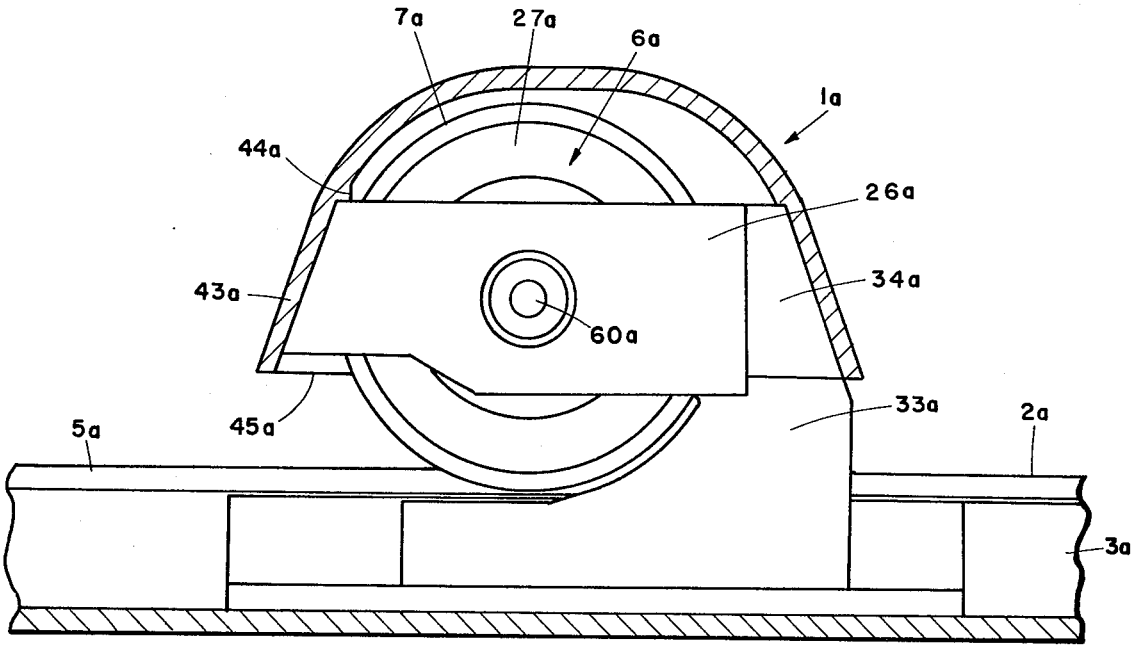
FIG. 9 is an enlarged, fragmentary vertical cross-sectional view of another embodiment of the cutter, which is particularly adapted for cutting thick sheet material.

The cutter 1 illustrated in FIGS. 1–9 is adapted for cutting relatively thin sheet material, and cutter bar or housing 2 (FIGS. 2 and 3) comprises an elongated tube having a rectangular or square transverse cross-sectional shape, with slot 5 positioned in the upper face 22 thereof. As best illustrated in FIGS. 7 and 8, cutter bar 2 includes a bottom wall 19, and opposing sidewalls 20*c* and 20*d*. The upper face 22 of cutter bar 2 has first and second portions 21*c* and 21*d*, which are spaced apart to define longitudinal slot 5 therebetween. With reference to FIG. 3, A channel 23 is provided in the lower interior face of the bottom wall 19 of cutter bar 2 at a position slightly offset of slot 5 (to the right as viewed in FIG. 3), and is adapted to receive and retain the lower end of blade 4 therein. Channel 23 is formed between a rib 24 and an enlarged lower corner bead 25. The channel 23 is sufficiently wider than the lower end of blade 4 to permit the blade to rotate or pivot freely therein, as well as to translate slightly in a shifting or articulated pattern for purposes to be described in detail hereinafter. The slot 5 is positioned centrally in face 22, and extends along a precise, straight line from one end of bar 2 to the other end. Cutter bar 2 is preferably constructed from a length of extruded aluminum channel, and is adapted for connection with a portion of a mounting and cutting assembly, such as cutting table 12 (FIG. 1).

Figure 5:
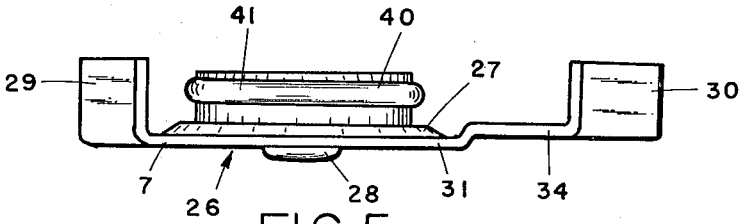
FIG. 5 is a top plan view of a rotary shear knife assembly portion of the cutter.

The knife assembly 6 (FIGS. 2 and 3) comprises a support frame 26 on which a disc-shaped, circular shearing knife 27 is rotatably mounted by a pin or rivet 28. As best illustrated in FIG. 5, support frame 26 is an open sided, integrally formed structure with a forward end 29, a rearward end 30, and a side panel 31. A plate-shaped bracket 33 (FIGS. 2 and 3) is formed integrally with and extends downwardly from an offset portion 34 of support frame 26. Bracket 33 extends through cutter bar slot 5 along the left-hand side thereof (as viewed in FIG. 3), and is attached to a slide 35 by suitable fastening means, such as an adhesive or the like. Slide 35 is telescopically mounted in cutter bar 2, and includes a lower right-hand projection or face 36 which engages the left-hand side wall of rib 24 to squarely retain the slide in the cutter bar, such that support frame 26 slides freely along the cutter bar in a perpendicular relationship.

A drive wheel 40 (FIG. 3) is fixedly attached to the circular knife 27 by an adhesive, or the like, for rotation therewith, and includes an O-ring 41 mounted in a recess in the periphery of the drive wheel. The O-ring 41 is positioned to abuttingly and frictionally engage the upper face 22 of cutter bar 2, or the sheet material disposed thereon, such that when the knife assembly 6 is slidably translated along cutter bar 2, the drive wheel 40 and circular knife 26 are simultaneously rotated about pivot pin 28.

The cutting edge 7 of the circular knife 27, illustrated in FIG. 3, is tapered sharply in the nature of 60 degrees with the outer periphery extending down past the blade cutting edge 4 to the lower surface of the upper face 22. It is to be understood that the shape of the cutting edges 4 and 7 may be varied greatly, including relatively blunt scissors edges, as discussed in greater detail hereinbelow. However, it is preferred that the knife edge 7 project below the blade edge 4 at least at one point to achieve a clean shearing action. The bracket 33 which connects support frame 26 with slide 36 is offset directly behind circular knife 27, such that as the sheet is cut, bracket 33 will not abut the sheet or otherwise interfere with the positioning of the cut sheet portions.

A cover 43 encloses the knife assembly 6, and comprises a one-piece molded structure with a ridge 44 formed in the interior thereof in which the ends 29 and 30 of the support frame 26 are received and are securely attached by means such as adhesive or the like. The sides of cover 43 are spaced away from the sides of the knife assembly to prevent interference with the rotation of circular knife 27. The exterior surface of cover 32 is shaped for grasping, and in the embodiment illustrated in FIGS. 1–8, the lower, free edge 45 of the cover is spaced sufficiently close to the top of bar 2 to prevent fingers from entering between them.

A hold-down roller 50 (FIGS. 2 and 4) is rotatably mounted in cover 43 directly before circular knife 27 (with respect to the direction of travel) to hold the sheet 8 down securely against the upper face 22 of cutter bar 2. The illustrated roller 50 is mounted between the side walls of the cover by a sleeve 51 and pin 52. The roller 50 includes an annularly shaped recess 53 which is disposed directly above slot 5, and permits blade 3 to shift freely between the extended and retracted positions, and also prevents the sheet from being pressed down into the slot. The roller 50 is preferably constructed of a resilient material such as rubber, which is adapted to firmly grip the sheet on both sides of slot 5 and hold the sheet taut therebetween.

The strip of resilient material 9 is positioned between the right-hand interior face of cutter bar 2 and the upper portion of blade 3, and resiliently urges the blade to the left (as viewed in FIG. 3), which in the cutting position is against the interior surface 46 of circular knife 27, and in the storage position, is against the side edge 47 forming the left-hand side of slot 5, as is discussed in greater detail hereinafter. The blade biasing strip 9 is constructed of a resilient material with return memory, such as a foam polymeric material or expanded synthetic. Strip 9 extends continuously along the length of blade 3, and is preferably connected with the back of blade 3 by an adhesive. The resilient strip 9 is assembled partially compressed or preloaded into cutter bar 2, and thereby retains blade 3 in the cutter bar.

Figure 6:
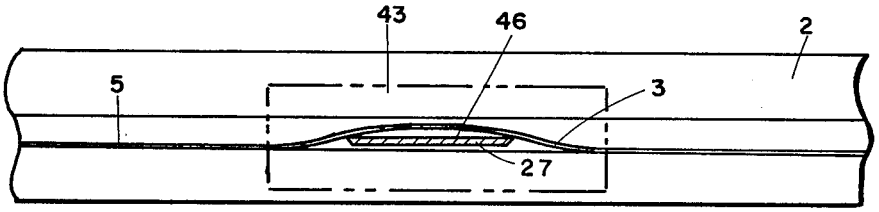
FIG. 6 is a schematic cross-sectional view of the cutter, showing a circular knife automatically deflecting a semi-flexible spring blade portion thereof.

The blade 3 illustrated in FIGS. 6, 7 and 8 is constructed from an elongate strip of resilient, semiflexible material, such as spring steel, with progressive portions capable of temporary resilient deformation. The lower edge 55 of blade 3 is positioned loosely in channel 23, and the blade is retained therein by resilient strip 9. The upper edge 56 of blade 3 is positioned between the bar side edges 47 which define slot 5. The blade 3 is disposed along a plane oriented substantially parallel with the plane along which knife 6 translates, and is deformable in directions transverse to the plane of the blade body. Blade 3 is pivoted or shifted between the slot sides 47, thereby raising and lowering the elevation of cutting edge 4. Resilient strip 9 urges the blade against the left-hand side edge 47 in the storage position, and against the interior surface 46 of the circular knife 27 in the cutting position. As the circular knife assembly 6 is drawn along cutter bar 2, the interior surface 46 of circular knife 27 engages the interior surface of blade 2, such that the knife pushes the portion of the blade with which it is engaged laterally (i.e., to the right as viewed in FIGS. 7 and 8), thereby shifting or lifting blade cutting edge 4. In the embodiment illustrated in FIGS. 1–9, the upper edge 4 of blade 3 is a cutting edge, sharpened to an acute angle, in the nature of 60°.

Circular knife 27 abuts blade 3 at two points (as shown in FIG. 6). The blade curvilinearly bends or twists around the two contacting points on the knife in the shape of a convex curve, such that the blade and knife assume a chordal relationship. The flexibility of blade 3 and the resilience of strip 9 are selected so that the cover 43 (FIG. 6) shields that portion of the blade which is shifted by the knife into the cutting position. As blade 3 is shifted from the storage position to the cutting position by knife 27, the cutting edge 4 of the blade moves from a retracted position below the upper surface 22 of cutter bar 2 to a position adjacent the lower surface of sheet 8 for engagement with the cutting edge 7 of knife 6 to shear the material therebetween. As the sheet 8 is sheared, and the knife assembly moves along the sheet, the resilient strip 9 shifts blade 3 back against the left-hand edge 47 of slot 5 into the retracted storage position, such that no sharp edges are exposed which could inadvertently cut the operator, and also to insure that the cutting edge is protected.

In use, the sheet cutter 1 (FIG. 1) is mounted in a suitable work station, such as cutting table 14. The sheet cutter illustrated in FIGS. 1–9 has an unidirectional cutting stroke, and therefore should be oriented on that side of the cutting table which is most convenient for the operator. A length of sheet material 15 is pulled or paid from roll 15 and drawn over the upper surface of cutter bar 2. The operator then initiates the shearing action by grasping the cutter cover 43 and pushing the assembly across the cutter bar 2 in the direction illustrated by the arrow in FIG. 1. As knife 6 approaches any particular section of material, hold-down roller 50 initially engages the sheet and presses the same firmly against the upper surface of the cutter bar. The leading edge of knife 7 engages blade 3 and shifts or pivots the adjacent portion of the blade from the retracted, storage position into the extended, cutting position wherein blade edge 4 is adjacent the lower surface of the sheet. The circular knife 27 then rotates into and through the sheet material, thereby shearing the sheet between the two cooperative cutting edges 4 and 7, which are at an acute angle to each other. Blade 3 is permitted to translate slightly from side-to-side in channel 23 by the non-rigid mounting of resilient strip 9, thereby imparting a "floating" action to the blade, and alleviating any binding with the sheet. Roller 50 holds the sheet tautly on bar 2 at opposite sides of slot 5, such that the rolling engagement of knife 6 into blade 2 does not permit the paper to be pushed down into slot 5 or to be cut with a folding action which creates uneven edges. After one portion of the sheet has been sheared, the knife assembly 6 moves away, the trailing edge of knife 7 disengaging the blade portion, and the resilient strip 9 automatically urges the portion in the blade 3 back into the retracted, storage position, such that there are no exposed blade portions on which the operator might inadvertently cut his fingers. Blade extension is thus progressive and temporary. Further, because the blade cutting edge 4 is retracted, it is protected against other types of abuse which might prematurely dull the cutting edge. After knife 7 has traversed across the entire width of the sheet 8, the cut portion of the sheet is removed, and the knife assembly is returned to its initial position.

Figure 10:
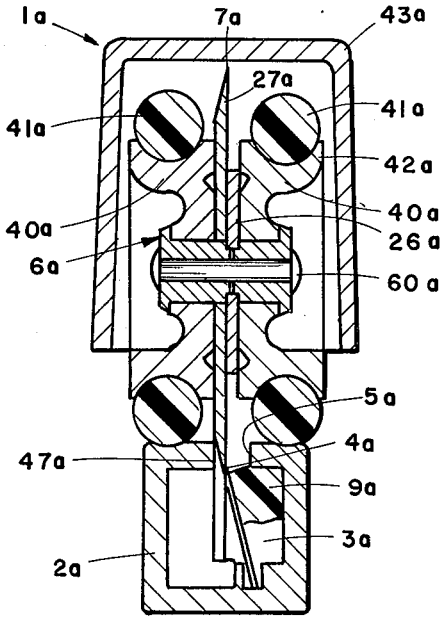
FIG. 10 is an enlarged vertical cross-sectional view of the cutter embodiment shown in FIG. 9.

The reference numeral **1*a* generally designates another embodiment of the present invention (FIGS. 9 and 10) which is particularly adapted for cutting thicker sheet materials. Since the cutter 1*a* is otherwise substantially the same as the previously described device 1, similar parts appearing in FIGS. 1–8 and 9–10 respectively are represented by the same corresponding reference numeral, except for the suffix "a" in the numerals of the latter. The space between the lower edge 45*a* of the housing 32*a* and the upper surface 22*a* of cutting bar 2*a* is sufficiently enlarged to permit thicker materials, such as sheets of foam, bubble material, and the like, to pass therebetween. The hold-down roller 50 has been eliminated. The cutter 1*a* also includes two drive wheels 40*a*, disposed on either side of the circular knife 7*a* and rotatably mounted on the support frame 26*a* by a central split sleeve and pin arrangement 60. Each of the drive wheels 40*a* includes an O-ring 41*a*. These O-rings are positioned on opposite sides of the slot 5*a* on the upper surface of the cutter bar 2*a*. The frictional forces developed between the O-rings 41*a* and the sheet being cut (not shown) assist in preventing the knife 7*a*** from drifting off of a straight line as it shears through thick material.

Sheet cutter **1*a* operates in a manner substantially identical with cutter 1, except that cutter 1*a* does not have a hold-down roller. Since the materials being sheared are thicker and therefore typically more stiff, a hold-down roller is not required. The space between the lower cover edge 45***a* and cutting bar 2*a* is sufficiently large to permit thicker materials to pass therebetween, and consequently will typically not prevent entry of the operator's fingers, such that a higher degree of care and caution should be exercised.

Figure 11:
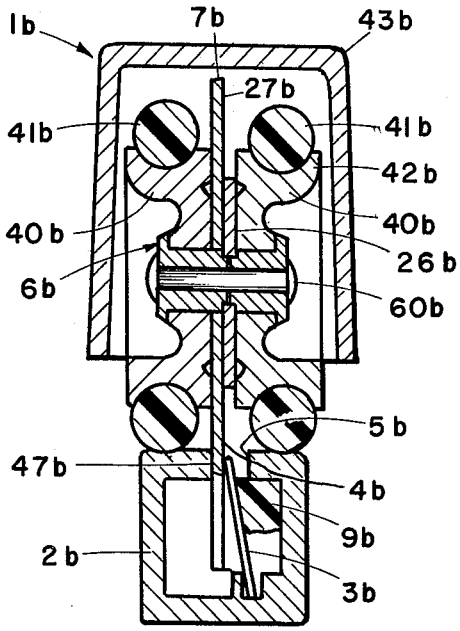
FIG. 11 is an enlarged vertical cross-sectional view of yet another embodiment of the sheet cutter, which is particularly adapted for cutting packing or cushioning materials.
Figure 12:
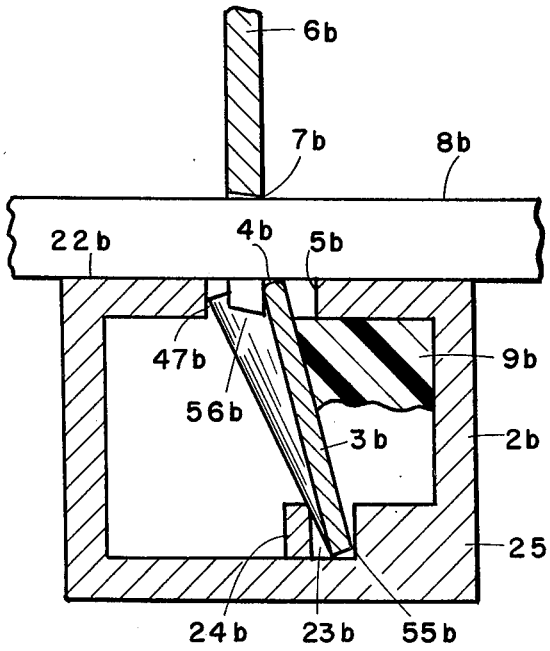
FIG. 12 is an enlarged, fragmentary vertical cross-sectional view of the cutter shown in FIG. 11, with the nearest portion of the blade shown in an extended, cutting position.

The reference numeral 1*b* designates yet another embodiment of the present invention (FIGS. 11–13) which is particularly adapted for cutting packing or cushioning material, such as urethane and polyethelene foam, bubble cushioning products, poly films, kraft paperback cushioning products, and other cellulosic cushioning product, and includes a dull cutting edge 4*b* on blade 3*b*. Since cutter 1*b* is otherwise substantially the same as the previously described cutters 1 and 1*a*, similar parts appearing in FIGS. 1–8, 9–10 and 11–13 respectively are represented by the same corresponding reference numeral, except for the suffix "b" in the numerals of the latter. Like cutter 1*a*, cutter 1*b* is also adapted to cut relatively thick panels of material 8*b*, such that the space between the lower edge 45*b* of housing 32*b* and the upper surface of cutting bar 2*b* is sufficiently enlarged to permit such materials to pass therebetween. Cutter 1*b* also includes a pair of drive wheels 40*b* disposed on either side of the circular knife 7*b*, and rotatably mounted on the support frame 26*b* by a central split sleeve and pin arrangement 60*b*. Each of the drive wheels 40*b* includes O-rings 41*b* positioned on opposite sides of slot 5*b* on the upper surface of the cutter bar 2*b*. The frictional forces developed between O-rings 41*b* and the material being cut (not shown) assist in preventing knife 7*b* from drifting off of a straight line as it shears through a thick material. The cutting edge 7*b* of circular knife 6*b* is sharp, but much less acute in angle than cutting edges 7 and 7*a*. Cutting edge 7*b* is formed at an angle in the nature of 83°.

Figure 13:
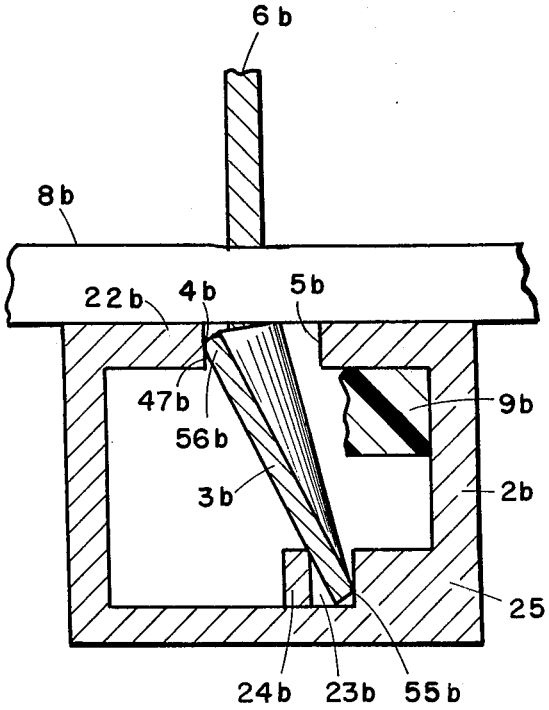
FIG. 13 is an enlarged, fragmentary vertical cross-sectional view of the cutter shown in FIGS. 11 and 12, with the nearest portion of the blade shown is a retracted, storage position.

The upper edge 4*b* of blade 3*b* is blunt, instead of the acute sharpened cutting edge of blades 3 and 3*a*. Blade 3*b* is preferably constructed of a segment of razor blade stock, wherein the upper edge 4 has not been sharpened, and has slightly rounded edges. This type of edge functions as an anvil that cuts material 8*b* as the cutting edge 7 of rotary knife 6 is engaged therewith. The blunt edge 4*b* of blade 3*b* has been found to be extremely durable, particularly under circumstances wherein foreign substances, such as paper clips, staples, et cetera, are used in the work station and tend to get caught between the rotary wheel and the cutting blade. This type of inadvertent contact can severely nick a sharpened blade edge, even to the extent that it forms an obstruction which is sufficiently large to prevent the knife from sliding along the cutter bar. Since edge 4*b* is not sharpened, it does not nick or deform as readily as a sharpened edge, and can therefore withstand much greater abuse. In this embodiment, the primary purpose of retracting the blade into the storage position, as shown in FIG. 13, is to present a flat, unobstructed surface on the top of cutter bar 2*b*, so that the panel of material can be drawn smoothly thereover, and also to protect the edge 4*b* from exposure to accidental blows or impacts, such as when objects are inadvertently dropped onto cutting bar 2*b*. During cutting, the upper edge 4*b* of blade 3*b* is shifted to a posiiton substantially flush with the upper surface 22*b* of cutter bar 2*b* to achieve a clean, quick, even cut.

Sheet cutter 1*b* operates in a manner substantially identical with cutter 1*a*, except that blade 3*b* functions as an anvil, against which the sharpened edge 7*b* of rotary knife 6*b* cuts the material.

The circular knife assembly 6 in conjunction with the pivoting spring blade arrangement 3 provide a cutter which has no exposed blade portions, and is therefore very safe, and also quite durable. Further, the semi-flexible nature of blade 3, in combination with resilient strip 9, automatically retracts the blade about the knife, such that the blade is concealed or shielded even during the cutting operation. A blunt-edged spring blade is used to evenly and quickly cut packing and cushioning materials.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A cutter for material, comprising:

a cutter bar having a bottom wall, opposing side walls and first and second upper wall portions defining a hollow interior, said upper wall portions being spaced apart to define a longitudinal slot; said upper wall portions each having an outer surface;

a blade positioned in the hollow interior of said bar and extending substantially along the length thereof and including an upper edge disposed within said longitudinal slot; said blade being mounted in said cutter bar in a manner which permits lateral displacement of the upper edge of said blade;

a movable knife connected with said cutter for translation along said slot, and including a cutting edge abuttingly engaging the upper edge of said blade for cutting material therebetween as said knife is moved along said bar; said blade having an extended, cutting position, wherein the upper edge of said blade is disposed substantially flush with the outer surface of said upper wall portions for cutting the material, and a retracted, storage position wherein the upper edge of said blade is disposed below the outer surface of said upper wall portions for storage;

resilient means for normally retaining said blade in the storage position; and wherein said knife is positioned over said slot in a location such that engagement between said knife and said blade shifts said blade from the storage position to the cutting position.

2. A cutter as set forth in claim 1, wherein:

said blade is semi-flexible for resilient deformation about said knife, whereby engagement between said knife edge and said blade edge shifts said blade into the cutting position at only that location adjacent where the material is being cut.

3. A cutter as set forth in claim 2, wherein:

said blade has a lower edge thereof nonrigidly mounted in a channel portion of said cutter bar.

4. A cutter as set forth in claim 3, wherein:

said channel portion is slightly wider than the width of the lower edge of said blade to permit limited lateral translation of said blade.

5. A cutter as set forth in claim 4, wherein:

said resilient means comprises a strip of expanded synthetic material which extends along the length of said blade, whereby said blade resiliently twists about said knife as said knife is drawn along said cutter bar for cleanly shearing the material along a straight line.

6. A cutter as set forth in claim 5, wherein:

said knife comprises a circular knife which rotates as the same is translated along said cutter bar.

7. A cutter as set forth in claim 6, including:

a cover shielding substantially all of those portions of said circular knife and said blade which extend above said cutter bar.

8. A cutter as set forth in claim 7, wherein said circular knife includes a friction wheel disposed above said cutter bar for abutting engagement therewith, whereby translation of said knife rotates said circular knife.

9. A cutter as set forth in claim 8, wherein:

said blade upper edge is blunt for cutting packing and cushioning materials.

10. A cutter as set forth in claim 8, wherein:

said blade upper edge is sharpened to an acute angle for cutting thin sheet materials.

11. A cutter as set forth in claim 10, including:

means for positively holding a sheet of material firmly against said cutter bar face.

12. A cutter as set forth in claim 11, wherein:

said holding means comprises a roller.

13. A cutter as set forth in claim 12, wherein:

said roller extends over said cutter bar face on both sides of said slot for urging said sheet thereagainst, and includes an annular groove therein in which the blade cutting edge is received during the cutting position.

14. A cutter as set forth in claim 1, wherein:

said blade has a lower edge thereof nonrigidly mounted in a channel portion of said cutter bar.

15. A cutter as set forth in claim 1, wherein:

said resilient means comprises a strip of expanded synthetic material which extends along the length of said blade, whereby said blade resiliently twists about said knife as said knife is drawn along said cutter bar for cleanly shearing the material along a straight line.

16. A cutter as set forth in claim 1, wherein:

said knife comprises a circular knife which rotates as the same is translated along said cutter bar.

17. A cutter as set forth in claim 16, wherein:

said circular knife includes a friction wheel disposed above said cutter bar for abutting engagement therewith, whereby translation of said knife rotates said circular knife.

18. A cutter as set forth in claim 1, including:

a cover shielding substantially all of those portions of said circular knife and said blade which extend above said cutter bar.

19. A cutter as set forth in claim 1, wherein:

said blade upper edge is sharpened to an acute angle for cutting thin sheet materials.

20. A cutter as set forth in claim 1, wherein:

said blade upper edge is blunt for cutting packaging and cushioning materials.

* * * * *